United States Patent [19]

Moore

[11] Patent Number: 4,825,480

[45] Date of Patent: May 2, 1989

[54] BATHTUB AND ALCOVE CONSTRUCTION

[75] Inventor: John W. Moore, St. Louis County, Mo.

[73] Assignee: The Swan Corporation, St. Louis, Mo.

[21] Appl. No.: 109,914

[22] Filed: Oct. 19, 1987

[51] Int. Cl.[4] ..... A47K 3/16

[52] U.S. Cl. ..... 4/595; 4/593; 4/614; 52/35; 52/582

[58] Field of Search ..... 4/595, 584, 592, 593, 4/614, 612, 613; 52/34, 35, 582

[56] References Cited

U.S. PATENT DOCUMENTS

| | | | |
|---|---|---|---|
| 1,962,784 | 6/1934 | Nelson | 4/595 |
| 2,122,247 | 6/1938 | Coordes | 4/595 |
| 3,158,237 | 11/1964 | Schooler | 52/35 |
| 3,564,788 | 2/1971 | Moore | 52/270 |
| 3,588,925 | 11/1968 | Kuypers et al. | 4/595 |
| 3,740,908 | 6/1973 | Moore | 52/261 |
| 3,845,600 | 11/1974 | Moore | 52/222 |
| 4,551,869 | 11/1985 | Whitney | 4/595 |

*Primary Examiner*—Henry J. Recla

*Assistant Examiner*—Linda J. Sholl

*Attorney, Agent, or Firm*—Kalish & Gilster

[57] ABSTRACT

For use with a building interior recess construction, such as, a stud pocket, a bathtub and alcove construction wherein there is provided a bathtub, and a back panel and a pair of side panels comprising a surround for said bathtub. First clip members are provided for fixedly engaging the bathtub to adjacent portions of the recess construction; and with there being second clip members also engaging said bathtub for cooperating with retainer elements carried on the back panel to assure of appropriate disposition of the developed surround with respect to the bathtub. The back panel contains at opposite ends forwardly directed, relatively shallow corner portions, each of which is provided with a vertically extending groove. Each side panel along one edge portion is provided with a tongue-like flange dimensioned for reliable and snug reception with the adjacent groove of the back panel. Brace elements are also provided for rigidifying the connection between the bathtub and a front apron integrally formed therewith.

3 Claims, 3 Drawing Sheets

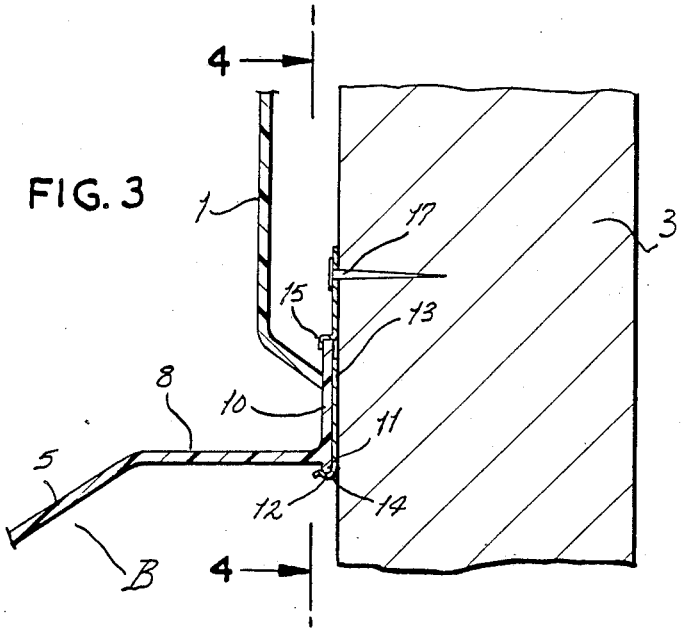
FIG. 3
FIG. 4
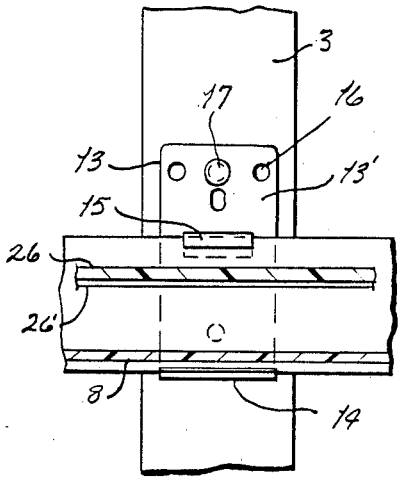
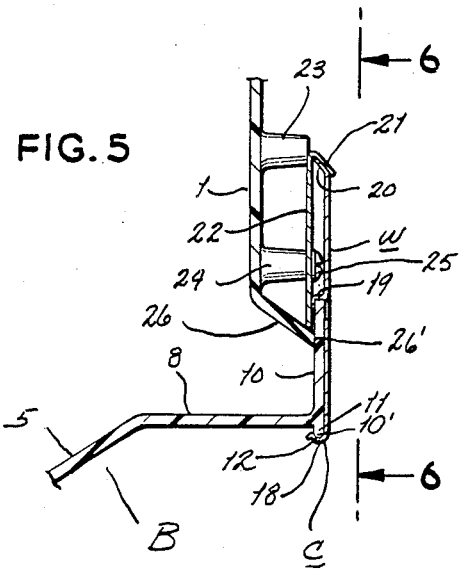
FIG. 5
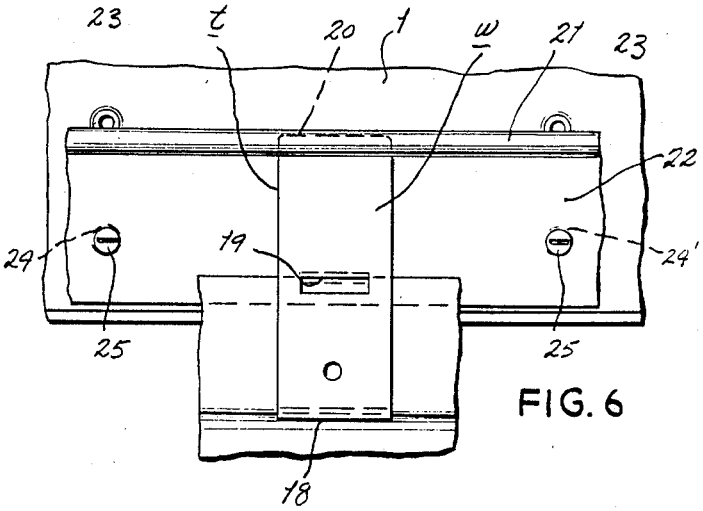
FIG. 6
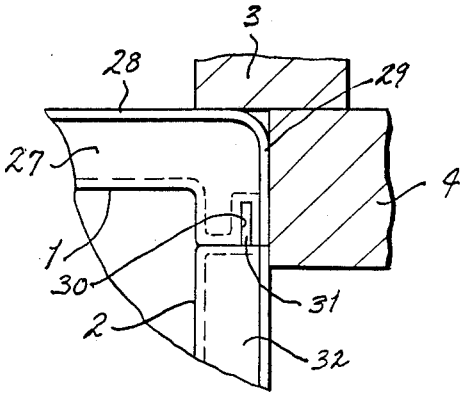
FIG. 7

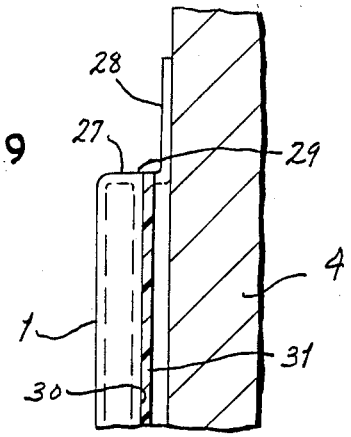
FIG. 9
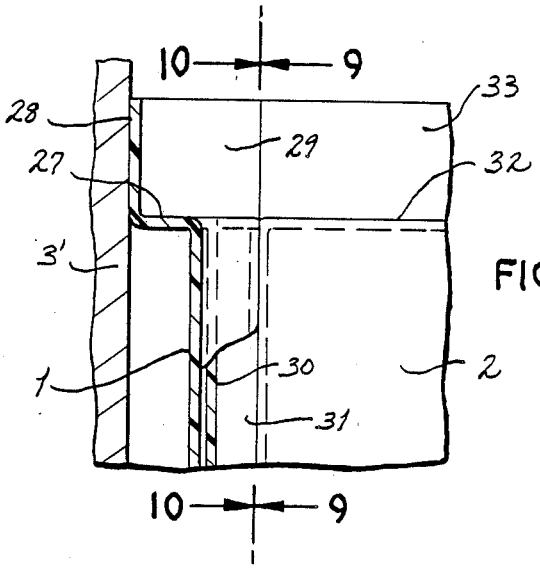
FIG. 8
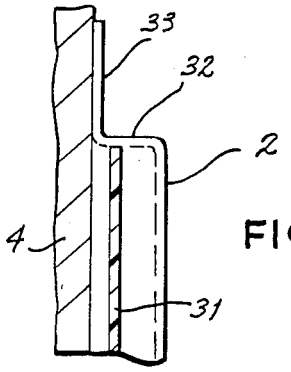
FIG. 10
FIG. 11
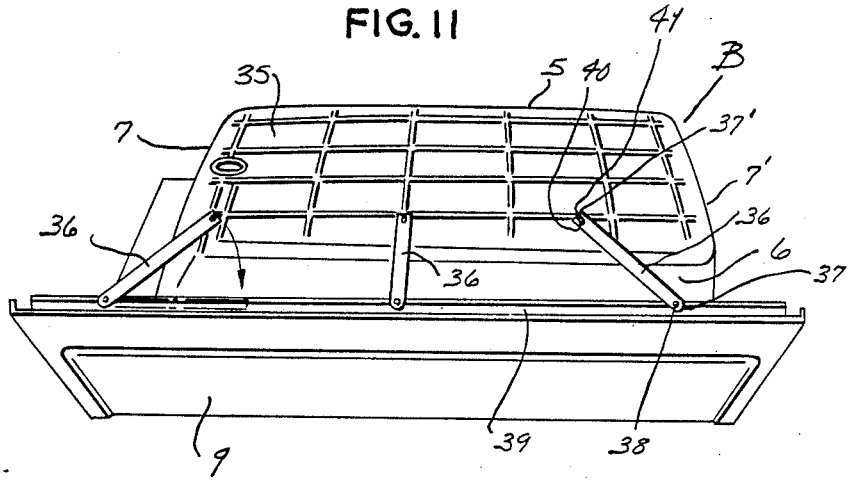

BATHTUB AND ALCOVE CONSTRUCTION

FIELD OF THE INVENTION

The present invention relates in general to bath alcoves and, more particularly, to an integrated bathtub and alcove construction.

BACKGROUND OF THE INVENTION

Description of the Prior Art

Heretofore, there have been numerous efforts to develop bathtub surrounds being generally of multi-panel construction with various means for endeavoring to mutually align and effectively interrelate such panels to bring about an attractive assembly with an independently installed bathtub. One such prior effort is revealed in Moore U.S. Pat. No. 3,740,908 which discloses a bathtub surround comprised of a back panel and side panels demonstrative of an effort to provide mutual adjustability for accommodating the particular structural recess receiving same. But expectedly there is no suggestion therein of any predetermined, interconnected relationship of such components with the bathtub.

Moore U.S. Pat. No. 3,845,600 also pertains to the provision of a surround, which consists of a biased wall panel of unitary, construction for permitting forceful adjustment of the inherent portions thereof for acceptance within the particular room opening. But here again, the thrust was to provide a surround devoid of any predetermined physical integration with a bathtub.

Reference may also be made to an earlier structure as shown in U.S. Pat. No. 3,564,788 wherein again the particular interconnection of the back panel and side panels of a surround constitute the inventive contribution; without suggestions as to any physical interengagement with the bathtub.

The foregoing thus exemplify that the teachings of the prior art have failed to reveal the inter-assembly of a bathtub and its surround, with all expected attendant benefits therefrom.

SUMMARY OF THE INVENTION

Accordingly, it is an object of the present invention to provide an integrated bathtub and alcove construction wherein the component members are physically interconnected so as to present a unified construction.

It is another object of the present invention to provide a bathtub and alcove construction wherein the bathtub serves fundamentally as an anchor for the surround so that the latter's relationship to the bathtub is of positive character; with the resulting ensemble being of overriding importance as distinguished from prior art structures wherein the aim was to locate the surround and then subsequently take all steps necessary to fit the bathtub therewithin.

It is a still further object of the present invention to provide novel means for securing the bathtub to the adjacent building structural components, as well as to the surround; which permit of facile mutual adjustability to assure of appropriate alignment both for operative effectiveness and pleasing appearance.

It is another object of the present invention to provide a bathtub and alcove construction wherein the constituents are fabricated of durable materials, yet sufficiently light in weight so that the installation does not require developed skill on the part of the particular assembler and, thus renders the same amenable to economic, high speed installation without peril of undesired imperfections.

It is still another object of th present invention to provide a bathtub and alcove construction of the type stated wherein novel means are provided for rigidifying the bathtub against shifting during usage.

It is another object of the present invention to provide a bathtub and alcove construction composed of a plurality of durably constructed components which are especially designed for facile interconnection; which are economic in production as well as installation; and which components coact to provide a bathtub and alcove construction of singular reliability and durability in usage.

BRIEF DESCRIPTION OF THE DRAWINGS

FIG. 3 is a vertical transverse sectional view taken on the line 3—3 of FIG. 1.

FIG. 4 is a vertical view, in partial section, taken on the line 4—4 of FIG. 3.

FIG. 5 is a vertical transverse sectional view taken on the line 5—5 of FIG. 1.

FIG. 6 is a vertical view taken on the line 6—6 of FIG. 5.

FIG. 7 is a fragmentary horizontal plan view taken on the line 7—7 of FIG. 1.

FIG. 8 is a vertical transverse sectional view taken on the line 8—8 of FIG. 1.

FIG. 9 is a vertical transverse sectional view taken on the line 9—9 of FIG. 8.

FIG. 10 is a vertical transverse sectional view taken on the line 10—10 of FIG. 8.

FIG. 11 is a bottom plan view, in perspective, of a bathtub constructed in accordance with and embodying the present invention, illustrating the apron braces in engaged condition.

DETAILED DESCRIPTION OF THE PREFERRED EMBODIMENT

Figure 1:
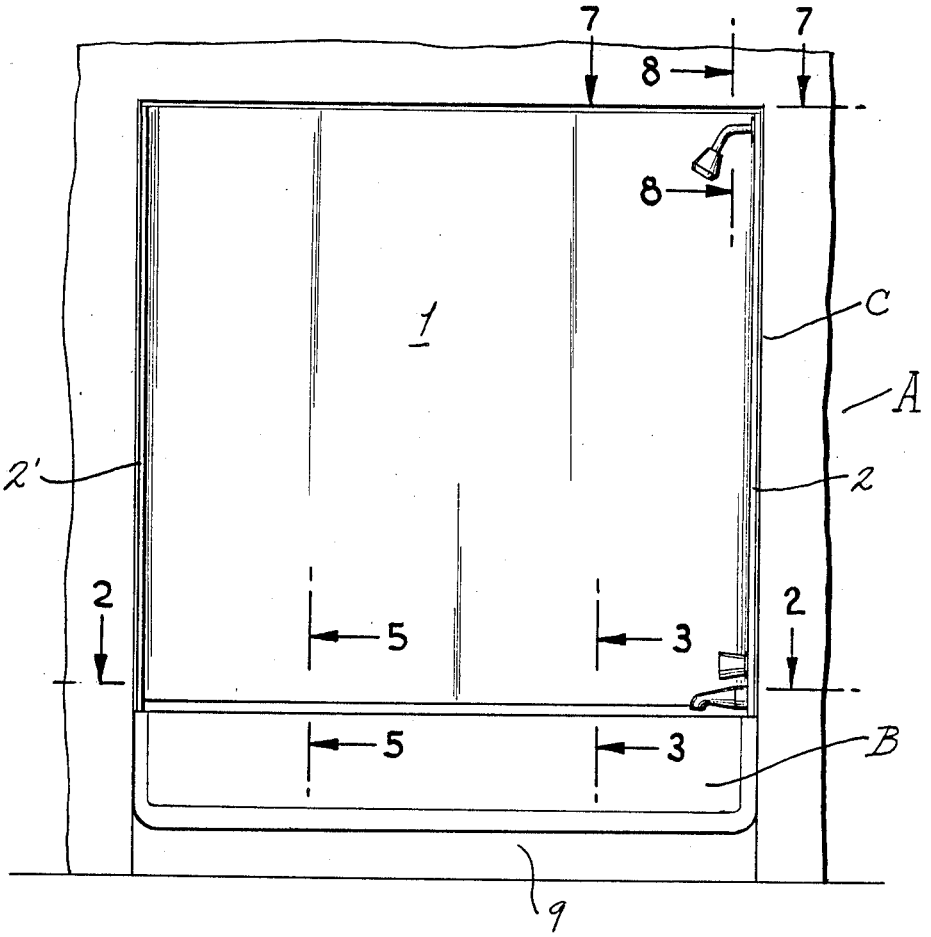
FIG. 1 is a front elevational view of a bathtub and alcove construction constructed in accordance with and embodying the present invention.

Referring now by reference characters to the drawings which illustrate the preferred embodiment of the present invention, A indicates an integrated bathtub and alcove construction comprising a bathtub B and a surround C, comprehending a back panel 1 and a pair of corresponding side panels 2,2'. Tub B and the components of surround C are preferably constructed of fiberglass or the like, being thus of relatively lightweight, water impervious, and extremely durable, tough material, which is expectedly amenable to molding.

For purposes of illustration, bathtub B and surround C are shown as being receivingly disposed within a stud pocket P which comprehends the usual upper and lower horizontals h with a plurality of interconnecting, vertically extending, studs such as of conventional "2×4" character, located on predetermined centers; the vertical studs defining the rear of pocket P being identified 3, whereas the like studs located at the opposite ends of pocket P are designated 4,4'. It is, of course, understood that the combination bathtub and surround could be unitarily installed against a masonry wall, but it is believed that reference to stud pocket P will be adequately revelatory for disclosure purposes. Further-more, bathtub B may be installed over any desired surface during any stage of construction, but when the combined bathtub and surround are installed within stud pocket P, it is desirable that the same be unitarily located prior to wall finishing.

It will be understood that pocket P is of conventional construction and does not form a part of the present invention but is environmental in nature to illustrate the typical room recess provided for the intended reception.

Bathtub B comprises a rear wall 5, a front wall 6, and end walls 7,7' for disposition of the latter proximate surround panels 2,2', respectively; and a bottom wall b. Said bathtub walls incline slightly inwardly and downwardly in conformity to normal molding practice; and the upper edges of rear wall 5 and end walls 7,7' are continuous with an outwardly extending horizontal flange or ledge 8. The outer edge of the portion of flange 8 projecting from front wall 6 is continuous with the upper edge of a downwardly projecting front apron 9 having a length in excess of bathtub B and bridges the distance between surround side panels 2,2' for presenting a finished appearance as well as a protective, structurally rigidifying expedient. The inner edge portion of flange 8 is integral with an upstanding flange 10, as may be in the order of 1½"; the vertical axis of which is perpendicular to the plane of flange 8 (see FIGS. 3 and 5). It will be seen that flange 10 includes at the lower end thereof, as at 11, a short extension 10' projecting slightly below flange 8, and having its terminus preferably roundedly contoured, as at 12, for purposes presently appearing.

Provided for spacedly selected disposition upon the back portion of flange 10 is a plurality of tub clips 13, which may be of any predetermined number, but in actual practice it has been found that with a bathtub having an overall length in the range of 6', four such clips have proved adequate.

With reference to FIGS. 3 and 4 it will be seen that each bathtub clip 13 comprises a flat, rectangular body 13'; formed of rigid metal plate stock, and having the lower extremity thereof formed, as at 14, arcuately for complementarily gripping the rounded terminus 12 of flange 10 in which state body 13' is located against the rearwardly directed face of flange 10. Upwardly spaced from lower end edge 11, each bathtub clip 13 is substantially centrally punched to effect the development of a forwardly and downwardly projecting finger 15, for embracing the upper edge of flange 10, whereby finger 15 and the lower contoured end 12 of clip 13 may securely be graspingly mounted upon flange 10, while permitting sufficiently limited play so each clip 13 can be shifted longitudinally with respect to flange 10 for alignment with a preselected stud 3. In its portion upwardly of the related finger 15, body 13' of each bathtub clip 13 is provided with a plurality of apertures, as indiciated generally at 16, whereby fasteners 17, such as nails, screws or the like, of suitable extent and strength, may be projected therethrough to effect snug securement of the related clip 13 with the proximate stud 3, thereby tying bathtub B to the structural recess or stud pocket P.

Figure 2:
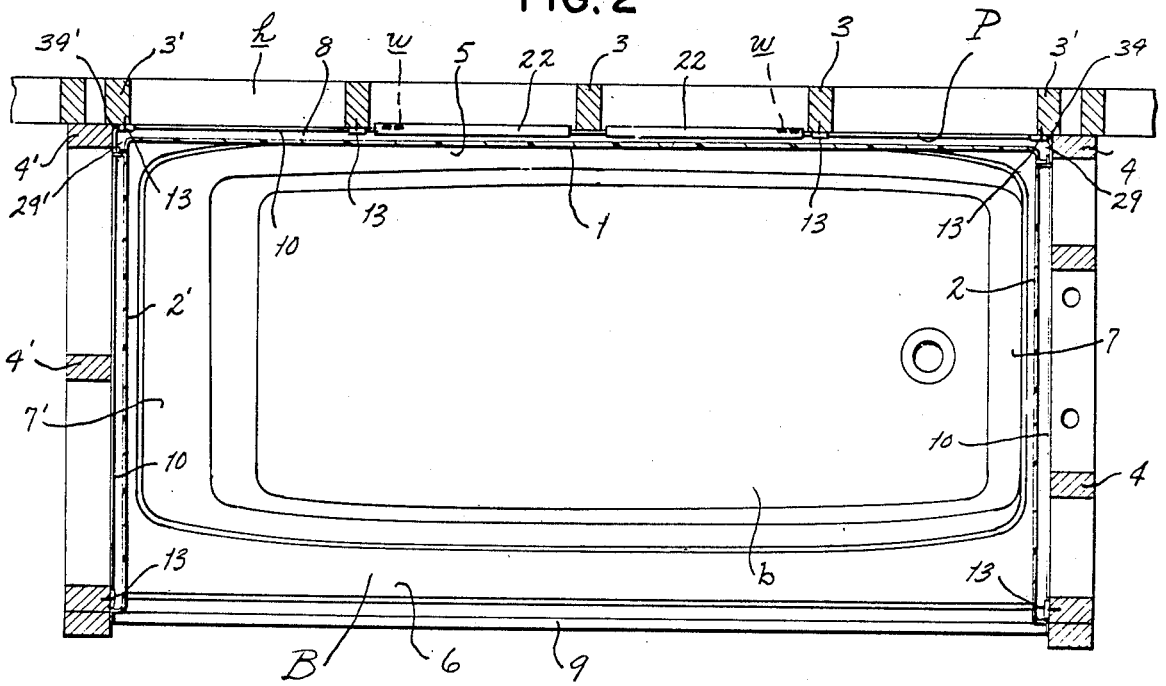
FIG. 2 is a transverse sectional view taken on the line 2—2 of FIG. 1.

As shown in FIG. 2, two bathtub clips 13 are preferably engaged to studs 3 between the ends of bathtub B, while two other bathtub clips 13 are engaged to end studs, as indicated at 3', respectively, substantially aligned with the ends of bathtub B. Thus, it will be seen that bathtub clips 13 serve to promote the snug and reliable anchorage of bathtub B to the rear portion of stud pocket P with stability in position being assured. As pointed out, bathtub clips 13 are adapted for relative movement along the rearward portion of upstanding flange 10 so that the dispersion of securement of bathtub B to the appropriate studs 3,3' is attained.

Also mounted for disposition upon the rearward portion of flange 10 is a plurality of wall clips w. In actual practice, since clips w will be disposed between the particular adjacent studs 3 the same should desirably be located upon flange 10 prior to mounting of bathtub clips 13.

With reference now being made to FIGS. 5 and 6, it will be seen that each wall clip w also contains a flat, generally rectangular body t, formed as of metal, and having a lower end edge portion 18 contoured, as at c, for complementarily accepting the lower rounded end 12 of flange 10. Substantially intermediate the lower and upper ends of each clip w the same is provided with a forwardly punched out finger 19 for gripping the upper edge of flange 10 so that by means of finger 19 and lower rounded end 18 wall clips w are reliably secured upon flange 10 but, yet, with there being such limited clearance as to allow the same to be moved longitudinally of flange 10 for requisite positioning. The upper ends 20, spacedly above fingers 19, each wall clip w is bent for inclination forwardly and upwardly, at a predetermined angle of less than 90°; being thus configured for reception within a retainer channel 21 provided at the upper end of a plate 22 fixedly carried upon the rear face of surround back wall 1.

With reference being now made particularly to FIGS. 5, 6 and 2, it will be seen that each plate 22 is suitably mounted upon back panel 1 in spaced relationship to the rear face thereof by means of pairs of vertically aligned, longitudinally spaced upper and lower bosses 23,23' and 24,24' integral with panel 1 and extending rearwardly therefrom. Each lower boss 24,24' is internally threaded (not shown) to engage screws 25 by which the related plate 22 is rigidly secured in position and with the related upper bosses 23,23' serving as spacers to inhibit any tendency of the associated plate 22 to bend toward panel 1. It will thus be seen that two such plates 22 are adequate for effecting securement of back panel 1 in proper relationship to bathtub B; said clips w being of such length as to be presented between adjacent studs 3 and hence non-interferring with bathtub clips 13. By virtue of the pairs of bosses 23,23', 24,24' a marked distance between the planes of back panel 1 and flange 10 is created so that the lower end of back panel 1, below said bosses, is rearwardly and downwardly inclined, as at 26, for abutment of its bottom edge 26' against back flange 10 to create an artistic, finished appearance to the line of jointure between bathtub B and surround panel 1.

For reasons to be discussed hereinbelow, bathtub clips 13 and wall clips w may be similarly utilized in conjunction with side panels 2,2', flange 10, and studs 4,4', but are not illustrated in order to avoid obvious repetition.

With particular reference to FIGS. 2, 8 and 9, it will be seen that back panel 1, at the upper end portion thereof, is turned rearwardly toward studs 3 of stud pocket P to define a co-extensive horizontal surface 27 which latter is integral with an upwardly projecting vertical flange 28 for flatwise abutment against studs 3. Flange 28 may be used as a nailing flange for extension therethrough, and into the adjacent studs 3, of preferably large head roofing nails for perfecting the securement of back panel 1 in position.

At each of the ends thereof, back panel 1 is provided with a short, forwardly directed corner-developing portion 29,29', the upper ends of which are continuous with surface 27 of panel 1 and with each of corner portions 29,29' containing a forwardly opening narrow groove 30 in the portion thereof proximate the adjacent end studs 4,4', as the case may be. Each groove 30 is open through the upper and lower ends thereof and is dimensioned for snugly receiving a tongue-forming flange 31 provided on the inner end of the adjacent side panel 2,2', as the case may be. With reference to FIG. 2, it will be seen that each side panel 2,2' is, with exception of flange 31, of similar configuration as back panel 1 so that the outer face of each side panel 2,2' will be continuous with the outer face of back panel 1. The upper end of each side panel 2,2' is provided with a horizontal surface 32 continuous with surface 27 of back panel 1 for pleasing symmetry and balance. The inner end of surface 32 is continuous with an upstanding coextensive nailing flange 33 for tight abutment against the confronting face of studs 4,4'. Flanges 33 thus serve for direct securement, as by large head roofing nails, within stud pocket P for enhancing the anchoring of surround panels 2,2'. It will be seen that flange 33 does not project above tongue-forming flange 31 so that when the latter is engaged panel flanges 28 and 33 will abut edgewise to provide an appearance of unbroken continuity.

For further increasing the rigidity of the surround portion of the bathtub and alcove construction, a suitable adhesive, such as, for example only, a silicon adhesive, may be applied within each groove 30 for enhancing securement of the received flange 31.

Manifestly, one of the side panels, such as 2, must be fitted with the requisite openings for the customary bathtub hardware, such as, shower heads, faucets and the like, so that the same may be suitably secured into operative position upon installation of surround panels, 1, 2, 2'.

From the foregoing it will be seen that the development of the bathtub and alcove construction of the present invention is readily apparent. Understandably, stud pocket P has been preliminarily constructed to the requisite measurements and with all supply lines to valves, tub spout and shower riser having been previously located. Trial fitting of bathtub B within stud pocket P to be certain that the same is level should be effected, as it may be necessary to shim under the tub for maximum overall floor contact.

Tub clips 13 are then snapped onto bathtub flange 10, as described above, and shifted slidingly lengthwise of flange 10 for facile disposition proximate the associated stud 3, (FIG. 2). In FIG. 4, clips 13 are shown with two of the same positioned at the ends of back panel 1 and two therebetween. Thus, for the average bathtub B, four such clips 13 are adequate, although, if desired, an additional number may be used, depending upon the number of studs 3 forming the rear portion of stud pocket P. Accordingly, tub clips 13 reliably maintain bathtub B in proper disposition within pocket P and with end walls 7,7' of bathtub B in abutment against studs 4,4', respectively, at the opposite ends of stud pocket P.

Thereupon, wall clips w are embracingly engaged upon bathtub flange 10 so as to be disposed between proximate studs 3 and thereby avoid any interference with clips 13. Two such wall clips w are shown in FIG. 2 as utilized with back panel 1. By reason of the length of wall clips w relative to the spacing between adjacent studs 3 the same will necessarily have negligible slideability so that the positioning of back panel 1 is all the more secure. Then back panel 1 is appropriately positioned with retainer channels 21 receiving the upwardly inclined upper ends 20 of the related wall clip w (see FIG. 5). Back panel 1 may thus be shifted relative to clips 13 by virtue of the relative slideability of retainer channels 21 and tub clip upper ends 20 to assure accurate positioning of back panel 1, with the end corner portions 29,29' received snugly in corresponding corners, as at 34,34', respectively, provided by end stud 3 and the proximate end panel stud 4,4', as the case may be. Then, as indicated above, back panel flange 28 may be nailingly affixed to the abutting studs 3 for stable permanent disposition of panel 1.

Before mounting end panels 2,2', the user may apply a suitable adhesive throughout the length of each groove 30 and then insert therein the selected tongue-like flange 31 thereby integrating the panels 1,2,2' of the now formed alcove into a unitary, attractive surround; it being understood that tub clips 13 and walls clips w would function in the same manner as with respect to back panel 1. Flanges 33 of end panels 2,2' are then secured to the adjacent studs 4,4', as by nailing, all as discussed hereinabove.

Referring now to FIG. 11, a particular feature for enhancing the rigidity of bathtub B will now be described. The base 35 of tub B is molded so as to present a substantially non-yielding, heavy ribbed design. Provided for spanning the distance between the lower end of apron 9 and front wall 6 is a plurality of braces 36 which are illustrated as being three in number, although there may be others if desired. Each brace 36 is of rigid, elongated character and the normally outer end 37 of each is pivotally secured, as by means of a rivet or pin 38 to a bottom inturned flange 39 formed at the lower end of apron 9. The inner end 37' of each brace 36 contains an aperture 40 dimensioned for snugly receiving a pin 41 integral upon base 35 of bathtub B. Each pin 41 is of such cross-section with respect to the associated aperture 40 to assure of a jam fit which is facilitated by the slightly yieldable character of the material of construction of each pin 41 so that such may be forced through the related aperture 40.

Thus, in shipping, and prior to installation, each brace 36 may be compactly disposed lengthwise of apron flange 39 and then immediately before positioning bathtub B the same may be swung into appropriate position and interengagement between pins 41 and apertures 40 effected. It is quite apparent that braces 36 serve to provide a markedly rigidifying expedient for bathtub B; inhibiting any relative movement between the same and apron 9 whereby any inadvertent impact upon apron 9 during usage will not promote any dislocation of bathtub B. The use of braces 36 thereby conduce to the economic production of bathtub B from lightweight, economic materials of construction, foremost among which is fiberglass.

What is claimed:

1. For use with a building interior recess having an intermediate and end wall portions, a bathtub and alcove construction for dispostion within said recess comprising a bathtub having a front wall, a rear wall, end walls, and a bottom wall with there being a vertically projecting flange extending from the upper portion of the bathtub rear wall said flange having opposed edges, a back panel and a pair of side panels for normal planar perpendicular relationship to said back panel, means securing said bathtub to said intermediate wall portion including means for engaging said flange and fastening means for engaging said securing means to said intermediate wall portion, said flange having a lower end portion extending below the upper portion of said bathtub back wall, means for effecting interengagement between said bathtub and said back panel comprising at least one wall clip having an upper end and opposed finger-like elements engaging the opposed edges of said bathtub flange, each such wall clip having an inclined edge at the upper end thereof, means for interengaging said side panels and said back panel and at least one retainer member mounted upon said back panel and having a channel complementary to the inclined edge of said at least one wall clip for accepting same.

2. The invention as defined in claim 1 wherein said at least one wall clip and said at least one retainer member are adapted for relative slideable movement to effect a desired mutual state of adjustment.

3. The invention as defined in claim 2 wherein said back panel, upwardly of the at least one retainer member, contains an upstanding flange for disposition against the proximate portion of the recess intermediate wall portion, and fasteners engaging said upstanding flange to the said wall portion.

* * * * *

UNITED STATES PATENT AND TRADEMARK OFFICE

CERTIFICATE OF CORRECTION

PATENT NO. : 4,825,480

DATED : May 2, 1989

INVENTOR(S) : John W. Moore

It is certified that error appears in the above-identified patent and that said Letters Patent is hereby corrected as shown below:

Column 6, line 64. Delete "dispostion" and insert --disposition--.

Column 6, line 68. After "wall" insert a comma.

Signed and Sealed this

Twentieth Day of March, 1990

*Attest:*

JEFFREY M. SAMUELS

*Attesting Officer*

*Acting Commissioner of Patents and Trademarks*